United States Patent [19]

Loniello

[11] 4,299,364

[45] Nov. 10, 1981

[54] INSULATING MODULE INCLUDING A HEATER ELEMENT SUPPORT

[75] Inventor: Peter J. Loniello, Watertown, Wis.

[73] Assignee: General Signal Corporation, Stamford, Conn.

[21] Appl. No.: 931,757

[22] Filed: Aug. 7, 1978

[51] Int. Cl.[3] ..... E21F 17/02

[52] U.S. Cl. ..... 248/58; 13/25; 219/537

[58] Field of Search ..... 248/58, 317, 59; 13/25; 219/537, 390; 85/3 R

[56] References Cited

U.S. PATENT DOCUMENTS

| | | | |
|---|---|---|---|
| 881,819 | 3/1908 | McIntosh | 85/3 R |
| 1,533,264 | 4/1925 | Reid | 13/25 |
| 1,563,743 | 12/1925 | Hazelwood | 85/3 R |
| 1,638,822 | 8/1927 | Biebel | 13/25 |
| 3,259,527 | 7/1966 | Beggs | 13/25 X |
| 3,604,304 | 9/1971 | Botting | 85/3 R |
| 3,866,017 | 2/1975 | Keren et al. | 219/390 |
| 4,055,723 | 10/1977 | Vanderford | 219/537 X |
| 4,154,975 | 5/1979 | Sauder | 13/25 |

FOREIGN PATENT DOCUMENTS

| | | | |
|---|---|---|---|
| 254394 | 12/1948 | Switzerland | 13/25 |

*Primary Examiner*—J. Franklin Foss

*Attorney, Agent, or Firm*—Parmelee, Johnson, Bollinger & Bramblett

[57] ABSTRACT

In a furnace insulating module, a plurality of heating element supports are embedded in situ in a ceramic fiber insulating body. Each support includes a rod with one end embedded in the insulating body. The rod is anchored to the insulating body by means of a cross pin welded to its embedded end. An element supporting keeper at the exposed end of the support rod is pivotable about a transverse pivot axis. The keeper is formed of a pin passing through the rod and bent to form fingers at both ends extending in opposite directions from the pivot axis. When the keeper is in a first position the fingers extend vertically, generally parallel to the support rod, and permit a rod overbend heating element to be moved along the rod to a position above the keeper. With the keeper then moved to a second position with the fingers in a horizontal plane, the heating element may be rested on the keeper fingers and be supported thereby.

10 Claims, 7 Drawing Figures

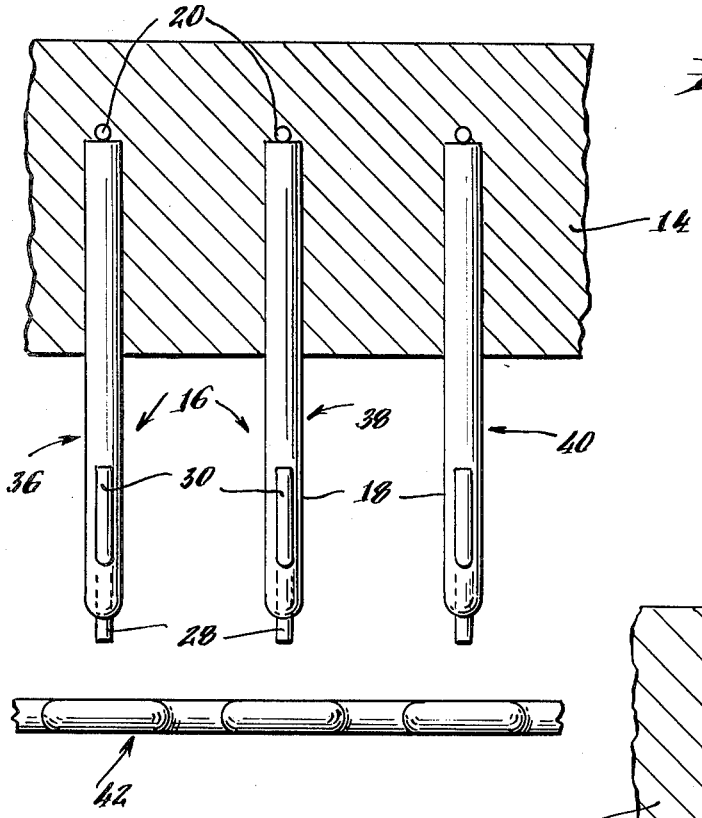
Fig. 5.
Fig. 6.
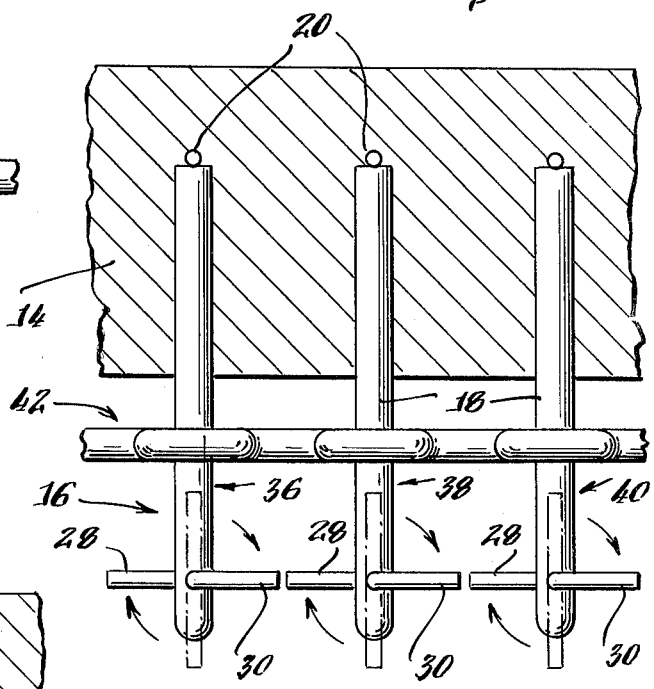
Fig. 7.
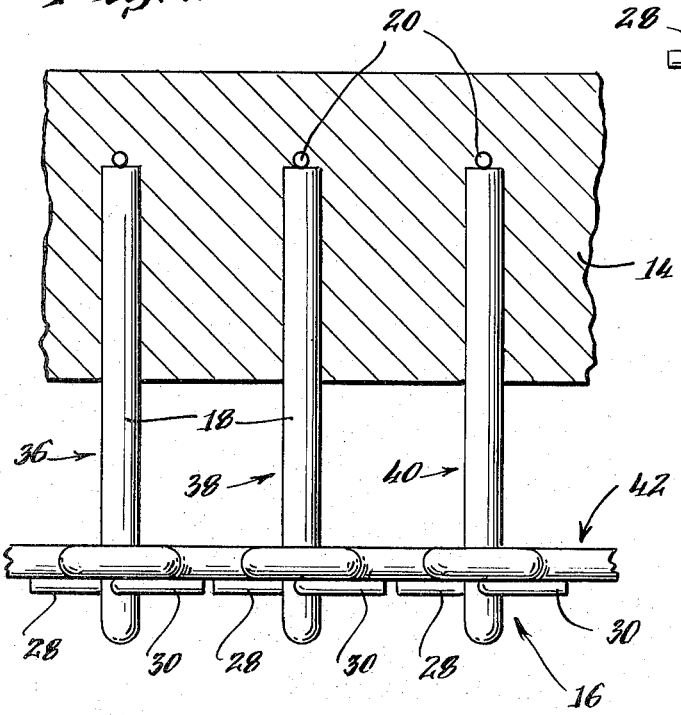

INSULATING MODULE INCLUDING A HEATER ELEMENT SUPPORT

BACKGROUND OF THE INVENTION

This invention relates to electric furnaces of the type utilizing insulation modules. More particularly, this invention relates to insulation modules to be mounted at the furnace roof and having means to support electric heating elements for the furnace.

In U.S. Pat. No. 3,500,444 to W. K. Hesse, et al, a lightweight ceramic fiber insulation is disclosed. Due to energy saving advantages, such ceramic fiber insulation is often used in place of more dense fire brick for furnace linings. Many of the insulation applications are for oil or gas fired furnaces. However, such insulation may also be used with electric heating elements as shown in the Hesse, et al patent and in the Werych U.S. Pat. No. 3,870,861. In those patents electric heating coils are embedded in the ceramic fiber.

An often preferred form of electric heating element for use in furnaces is that which has become known as the rod overbend type of heating element. Such a heating element is formed of a single, substantially rigid rod suitable for conducting electricity and thereby becoming heated. To form an overbend element, a rod is bent around forming rods into successive parallel passes of a heating element. An example of such a rod overbend heating element is shown at 42 in FIG. 4. Although named for the specific preferred method of forming the successive pass configuration of the rod overbend element, the element may be formed by any of a number of other methods.

With the increased use of ceramic fiber insulating modules to insulate the roofs as well as walls of furnaces, it has become desirable to provide appropriate means for supporting a rod overbend element below a ceramic fiber furnace roof. An object of this invention is to provide such a heating element support, especially one which is structurally simple yet quite durable.

It is a further object of this invention to provide such a heating element support which provides for quick mounting and quick release of rod overbend heating elements so that the heating elements may readily be replaced as necessary without damaging the furnace.

SUMMARY

In a preferred embodiment of the invention to be described, an insulating module includes an insulating body and a plurality of support rods. One end of each support rod is embedded in and anchored to the insulating body, and the other end of each rod extends outwardly from a surface of the insulating body. An element-supporting keeper is pivotable about a transverse pivot axis near the exposed end of each support rod. Each keeper includes fingers extending in opposite directions from the transverse pivot axis. In one position of the keeper the fingers extend generally parallel to the support rod to permit a heating element to be moved into or out of place relative to the insulating module. In a second position of the keeper, the fingers extend transverse to the support rod between successive passes of a rod overbend heating element to thereby engage and suspend the heating element below the insulating body.

According to the invention in another of its aspects, the keeper comprises a pin extending through the support rod. End portions of the pin are angled in opposite directions to form support fingers.

In accordance with another aspect of the invention, the support rod is anchored to the insulating body by a cross pin fixed to the embedded end of the support rod.

A rod overbend heating element may be supported on the keeper by placing the keeper in its vertical position, raising the heating element along the support rod to a position above the keeper, and then pivoting the keeper to its horizontal position. The heating element may then be rested on the fingers of the keeper.

BRIEF DESCRIPTION OF THE DRAWINGS

The foregoing and other objects, aspects, and advantages of the invention will be apparent from the following detailed description of a preferred embodiment of the invention, considered together with the accompanying drawings in which like reference characters refer to the same parts throughout the different views. The drawings are not necessarily to scale, emphasis instead being placed upon illustrating the principles of the invention. In the drawings:

FIG. 5 is a side view of three element supports embedded in an insulating body with the respective keepers in their vertical positions for receiving a heating element;

FIG. 6 is a side view of the supports and heating element of FIG. 5 with the heating element in a raised position above the keepers, and the keepers rotated to their horizontal positions;

FIG. 7 is a side view similar to FIG. 6 but with the heating element resting on the keepers.

DESCRIPTION OF A PREFERRED EMBODIMENT

Figure 1:
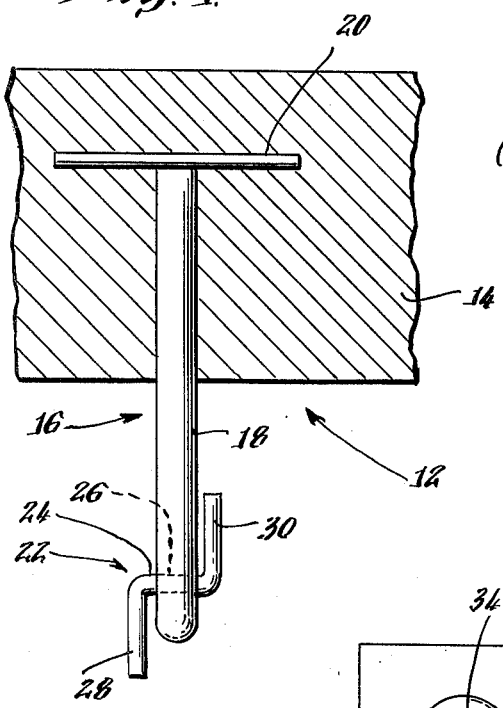
FIG. 1 is a front view of a heating element support shown embedded in an insulating body.

Referring now to FIG. 1, there is shown a section of an insulating module comprising a ceramic fiber insulating body 14 which is sectioned in the drawing to show embedded in its interior an element support generally indicated at 16. The support 16 includes a vertical support rod 18, one end of which is located within the insulating body 14, and securely held therein. The anchoring of the rod 18 within the insulating body is enhanced by a cross pin 20 welded to the embedded end of the rod.

At the opposed end of the rod 18, an element supporting keeper 22 is pivotably mounted on the rod. The keeper 22 is a pin including a central pivot portion 24 extending along a transverse pivot axis through a hole 26 in the support rod. End portions 28 and 30 of the pin are bent relative to the central pivot portion. The bent end portions form fingers extending in opposite directions from the transverse pivot axis. The two fingers of each support are in a common plane, together with the pivot portion 24.

In one method for forming the assembly of the keeper 22 and rod 18, the keeper pin first is heated and bent at one end to form one finger 28. Then the straight end is inserted through the hole 26, heated, and bent to form the other finger 30.

The insulating body preferably is of the type disclosed in U.S. Pat. No. 3,500,444. As disclosed in that patent, ceramic fibers may be combined in a slurry with a liquid binder. When the liquid is drawn from a mold as by suction, a hard, molded ceramic fiber body remains. In accordance with this invention, during the ceramic fiber molding process several supports 16 are inverted and suspended at a proper level within the mold. Then, the slurry is poured into the mold and the slurry encapsulates the ends of the supports having cross pins 20. When the liquid is then drawn from the slurry, the supports remain embedded in the ceramic fiber body.

Figure 2:
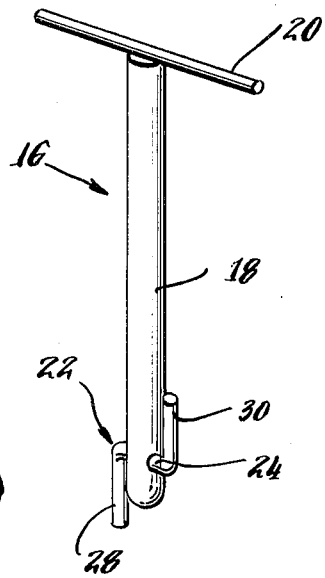
FIG. 2 is a perspective view of an element support with the keeper in its vertical position.
Figure 3:
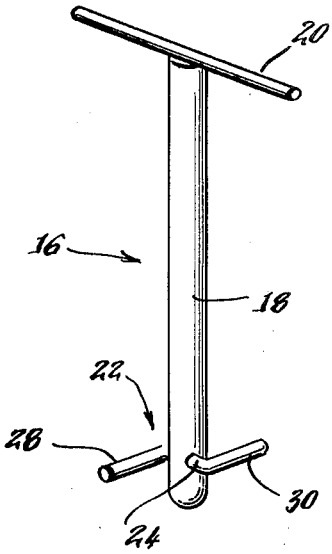
FIG. 3 is a perspective view of the support of FIG. 2 but with the keeper in its horizontal position.

FIGS. 2 and 3 show an element support with the keeper 22 in a first vertical position (FIG. 2) and in a second horizontal position (FIG. 3). The keeper is freely rotatable about the central pivot portion 24, but, as will be discussed below, the weight of an engaged heating element holds the keeper in the second position of FIG. 3 when the heating element is rested on the fingers 28 and 30.

Figure 4:
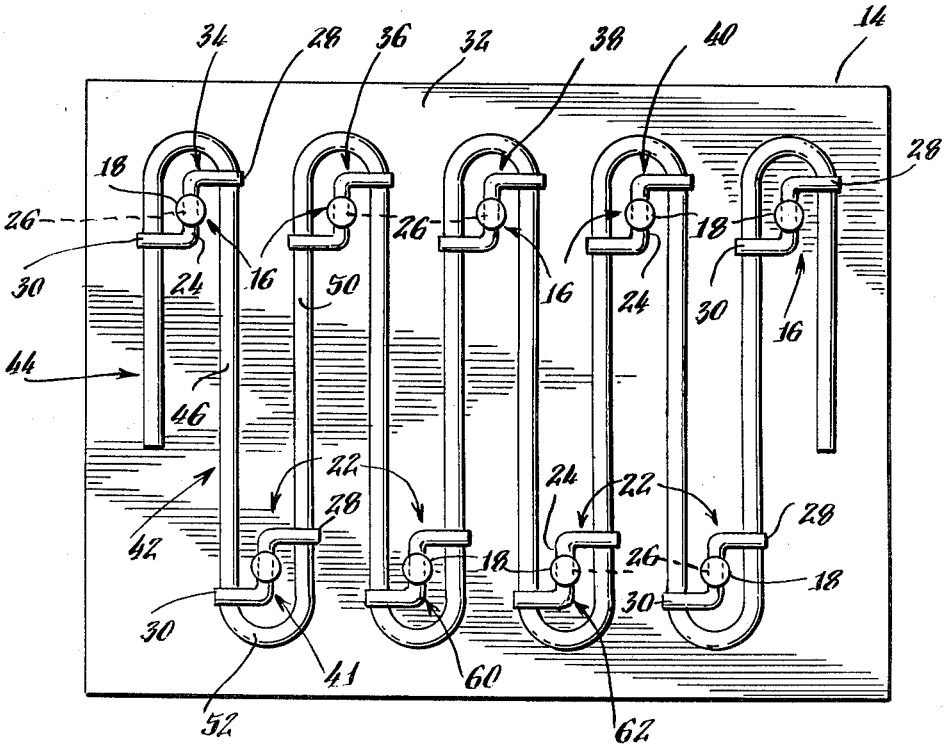
FIG. 4 is a bottom plan view of an insulating module with a plurality of supports suspending a rod overbend heating element.

As shown in FIG. 4, the insulating body 14 has a rectangular lower surface 40. Although not shown as such, the insulating body may be shaped to interfit with other insulating bodies in a tongue and groove or shiplap fashion to complete a furnace roof. A plurality of element supports 16 (in this case nine) extend downwardly from the lower surface 40 of the insulating body. A rod overbend heating element 42 rests on fingers 28, 30 of respective keepers. The rod overbend heating element 42 includes a series of parallel passes, such as 44, 46 and 50, of a rigid electric heating rod. The passes are joined by bend portions such as 48, 52 and 54.

The sequence of moving the rod overbend heating element 42 into its supported position is illustrated by FIGS. 5 through 7. In FIG. 5 each of the keepers is in its vertical position with fingers 28, 30 generally parallel to each support rod 18. A heating element 42 is shown in a ready position below the supports with the parallel passes of the element directed into the page. In these views, for clarity only the element supports 36, 38 and 40 adjacent bend portions 54, 56 and 58 are shown. Additional supports 60 and 62 would also be seen behind and staggered relative to those supports.

The heating element 42 is moved upwardly with pairs of passes straddling each support rod. Then, with the heating element held above the keepers, the keepers are rotated to the horizontal positions shown in FIG. 6. Finally, the heating element is lowered so that respective passes of the heating element rest on oppositely directed fingers of each keeper (FIG. 7).

The keepers are retained in their horizontal positions by the weight of the heating element. As can be seen from FIGS. 6 and 7, if any keeper were to pivot from its horizontal position, one of the fingers 28, 30 would move upwardly from the horizontal plane. However, in that event the weight of the adjacent pass of the heating element would press down against that finger to stop it from moving up. Thus, by preventing either finger from pivoting upwardly, the weight of the heating element holds the fingers in the horizontal plane.

With the heating element resting on the keepers, the support rods 18 block lateral movement of the heating element which could result in the element slipping off the fingers. For example, if, due to vibrations or the like, the heating element 42 were to move toward the top of the drawing of FIG. 4, bend portions of the element such as bend portion 52 would be stopped by adjacent support rods such as that of support 41. Similarly, if the heating element were to move down in the drawing of FIG. 4, support rods such as those in supports 34 and 36 would interrupt movement. Finally, with respect to leftward or rightward movement of the heating element, the fingers 28 and 30 are made sufficiently long that the passes of the heating element would engage the support rods before the heating element slipped off the ends of the fingers.

From the above description of a preferred embodiment of the invention, it will be apparent that a heating element may be held in place in a secure fashion by the support structure disclosed herein. Moreover, the heating element can easily be released for removal, as for servicing or replacement. This can be done by first lifting the heating element well above the keepers, and then moving the keepers to their vertical positions. The heating element then can be shifted downwardly past the keepers, and repaired or replaced without any damage to the insulating module.

While the invention has been particularly shown and described with reference to a preferred embodiment thereof, it will be understood by those skilled in the art that various changes in form and details may be made therein without departing from the spirit and scope of the invention as expressed by the appended claims.

What is claimed is:

1. An insulating module including a heating element support, said module comprising:

an insulating body;

a plurality of support rods, one end of each rod being embedded in and anchored to said insulating body and the other end of each rod extending outwardly from a surface of said insulating body;

a keeper carried by each support rod and shiftable between first and second positions about the extending end of the associated support rod, each of said keepers including fingers extending in opposite directions, generally parallel to said support rod when said keeper is in its first position and transverse to said support rod when said keeper is in its second position; and means for mounting said keeper to provide for rotational movement thereof between said two positions, about an axis transverse to said support rod;

said keeper comprising a pin through a transverse hole in said support rod;

said fingers being angled end portions of said pin on either side of said support rod.

2. An insulating module as claimed in claim 1 including a cross pin secured to the embedded end of said support rod to augment the grip of said module on said support.

3. An insulating module for installation in the roof of an industrial furnace including support means for an electrical heating element of the type comprising a plurality of parallel segments positioned generally side-by-side beneath the roof of said furnace, said module comprising:

an insulating body;

a plurality of support rods, one end of each rod being fixedly embedded in and thereby anchored integrally to said insulating body, the other end of each rod extending outwardly from a surface of said insulating body;

a keeper for each support rod;

means mounting each keeper on its support rod to provide for relative movement between the keeper and its rod;

said mounting-means providing for shifting movement of said keeper between first and second positions about the extending end of the associated support rod;

each of said keepers including at least one finger extending generally parallel to said support rod when said keeper is in its first position and transverse to said support rod when said keeper is in its second position;

each keeper further comprising means maintaining its finger in said transverse position when said heating element segments are resting on and supported by said fingers.

4. An insulating module as claimed in claim 3, wherein said mounting means comprises means to provide for rotational movement of said keeper between said two positions, about an axis transverse to said support rod.

5. An insulating module as claimed in claim 4, wherein said keeper comprises a pin through a transverse hole in said support rod.

6. An insulating module as claimed in claim 3, including cross pins secured to the embedded ends of said support rods.

7. An insulating module as claimed in claim 3, wherein said insulating body is a ceramic fiber insulating body.

8. Apparatus as claimed in claim 3, wherein said keepers comprise two fingers on opposite sides of the rod and are in said second position; and a heater element supported by said keepers, said element including portions resting upon said opposite fingers of each keeper and preventing said keeper from rotating.

9. Apparatus as claimed in claim 3, wherein said keepers comprise two fingers on opposite sides of the rod and arranged in a generally horizontal plane when in said second position to provide for support of two corresponding portions of said element.

10. An insulating module including a heating element support, said module comprising:

a ceramic fiber insulating body;

a plurality of support rods, one end of each rod being embedded in said insulating body with the other end of the rod being located remotely from a surface of said insulating body;

a cross piece secured to the embedded end of each said support rod; and an element-supporting keeper pin extending through a hole formed in each of said support rods adjacent the remote end thereof and rotatable between first and second positions about a pivot axis transverse to said support rod, the end portions of each of said keeper pins being bent to form fingers extending in opposite directions from said transverse pivot axis, said fingers extending generally parallel to said support rod when said keeper pin is in its first position and transverse to said support rod when said keeper pin is in its second position.

* * * * *